US006711816B2

(12) United States Patent
Tsunematsu

(10) Patent No.: US 6,711,816 B2
(45) Date of Patent: Mar. 30, 2004

(54) METHOD OF MANUFACTURING ELECTRICAL CONNECTOR FOR FLAT CABLE

(75) Inventor: Kazuhisa Tsunematsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/444,968

(22) Filed: May 27, 2003

(65) Prior Publication Data

US 2003/0217464 A1 Nov. 27, 2003

Related U.S. Application Data

(62) Division of application No. 10/091,577, filed on Mar. 7, 2002, now Pat. No. 6,602,083.

(30) Foreign Application Priority Data

Mar. 23, 2001 (JP) ..... 2001-83962

(51) Int. Cl.[7] ..... H01R 43/04

(52) U.S. Cl. ..... 29/882; 29/874; 29/876; 29/861

(58) Field of Search ..... 29/882, 876, 874, 29/857, 861

(56) References Cited

U.S. PATENT DOCUMENTS 6,171,137 B1 1/2001 Hatakeyama

FOREIGN PATENT DOCUMENTS

| | | |
|---|---|---|
| EP | 0618643 A | 10/1994 |
| EP | 0743715 A | 11/1996 |
| EP | 0773608 A | 5/1997 |
| JP | 9-35828 | 2/1997 |

*Primary Examiner*—Carl J. Arbes
(74) *Attorney, Agent, or Firm*—Kanesaka & Takeuchi

(57) ABSTRACT

A method for manufacturing an electrical connector for a flat cable, wherein the connector has at least one terminal (2) inserted into a receiving slot (3) of a box-shaped housing (1) from a side of the housing and having upper and lower arms (4 and 5), comprises the step of inserting the terminal into the receiving slot in a manner that the upper arm and lower arms are guided by inner surfaces of upper and lower walls of the housing, respectively, while the lower arm is deflected toward the upper arm and then deflected back to its original shape at a time of insertion to a predetermined position.

6 Claims, 3 Drawing Sheets

METHOD OF MANUFACTURING ELECTRICAL CONNECTOR FOR FLAT CABLE

CROSS REFERENCE TO RERATED APPLICATIONS

This is a divisional application of prior application number 10/091,577, filed Mar. 7, 2002 now U.S. Pat. No. 6,602,083.

BACKGROUND OF THE INVENTION

1. Field of the Invention

The present invention relates to electrical connectors for a flat cable and its manufacturing method.

2. Description of the Related Art

An electrical connector of this type is used by being attached to a circuit board. For a known electrical connector of this type, there is one disclosed in Japanese patent application Kokai No. 9-35828.

As FIG. 3 shows, in this connector, a flat cable (flexible board) 51 is inserted into an inserting space of an open mouth 53 in a direction of the flat cable surface, direction A, so as to be placed on contact sections 54A of terminals 54 which are arranged facing to the open mouth of a housing 52. In the figure, the terminals are made by stamping a metal sheet maintaining its flat surface, and are arranged with predetermined spacing in a perpendicular direction to the plane of the figure.

A pressure member 55 to open and close the open mouth is provided at the open mouth 53 of the housing 52, so as to freely turn around. The pressure member 55 enables the insertion of the flat cable 51 by opening the inserting space at the illustrated open position, and presses the inserted flat cable 51 so that the flat cable connects with a contact section 54A of the terminal at the closed position where the pressure member is turned downward.

The above-described terminal 54 has an upper arm 57 and a lower arm 58. The upper arm 57 is supported by an upper wall 52A of the housing 52, and has a bearing section 59 at its end, while the lower arm 58 has a contact section 54A at its end. The pressure member 55 is supported at circular end surface of the bearing section 59 of the terminals 54 so as to freely turn around.

There is a demand for a low-profile connector to miniaturize the electronic equipment where this type of connector is used, that is, a demand to be smaller in height direction in FIG. 3.

However, in the connector in FIG. 3, since an upper wall 52A of the housing supports the bearing section 59 which receives rotational force, it is difficult to reduce the thickness of the upper wall 52A. Also, the bearing section 59 is positioned under the upper wall 52A, and its circular section protrudes downward, which make the connector high as a whole.

SUMMARY OR THE INVENTION

Accordingly, it is an object of the present invention to provide an electrical connector for a flat cable which is low-profile, without impairing the strength of the bearing section.

The electrical connector according to the present invention has a plurality of terminals which are inserted from side to corresponding receiving slots, and arranged at a substantially box-shaped housing. The terminal has a contact section at a position facing to an open mouth of the housing. A pressure member which can freely turn around a rotational axis is provided at an opposite side of the contact section to a flat cable that is inserted from the open mouth and placed on the contact sections. The pressure member can freely turn over between an open position which opens an inserting space so as to enable insertion of the flat cable into the open mouth, and a closed position to press the flat cable to the contact sections closing the inserting space.

The electrical connector of the present invention has an opening on a part of an upper wall of the housing, and the opening is open towards an open mouth. The pressure member, which is supported by a bearing section formed at a support member held in the housing, so as to freely turn over, can move into the opening at a time of its turning over to the open position. An upper edge of the bearing section of the support member is positioned outer than an inner surface of the upper wall of the housing.

According to the present invention, since the upper edge of the part which has the bearing section of the support member is positioned outer than the inner surface of the upper wall of the housing, as described above, the height of the terminal is reduced, taking advantage of the thickness of the upper wall. In this case, the thickness of a portion around the bearing section is not reduced so that the strength of the bearing section is not impaired.

In the present invention, it is preferable that a lower wall of the housing covers substantially whole area of the lower surface so as to be placed on a circuit board where the electrical connector is to be attached. The support member can be a part of the terminal. In this case, the terminal has an upper arm and a lower arm which extend along inner walls of the upper wall and the lower wall respectively. The upper arm has a bearing section, and the lower arm has a contact section. At least the lower arm has flexibility towards the upper arm, and the upper and the lower arms are designed so as to be inserted and attached along the inner surfaces of the upper and the lower walls respectively.

Preferably, a lower edge of the lower arm of the terminal is slanted upward to its end. By this slanting, when the terminal is inserted from side to a receiving slot of the housing, the distance between the ends of the upper arm and the lower arm, which are inserting ends, is made smaller, so that it is easier to insert the terminal. At this time, it is further preferable that the lower arm has larger flexibility than the upper arm.

To manufacture the connector of the present invention, in a case that a support member is a terminal and has an upper and a lower arms, insert the terminal into a receiving slot in a manner that the upper and the lower arms are guided along the inner surfaces of the upper and lower walls respectively, while deflecting the lower arm towards the upper arm. Then, when it is inserted to a predetermined position, the connector is completed by releasing the deflection of the lower arm.

Also, in a case that the lower arms is slanted upward to its end, after tilting the terminal downward so that the slant of the lower arm is parallel to the inner surface of the lower wall, start insertion of the terminal into the receiving slot in a manner that the slant section is guided to inner surface of the lower wall. Then, continue the insertion to the predetermined position by releasing the tilting of the lower arm so as to complete the manufacture of the connector.

BRIEF DESCRIPTION OF THE DRAWINGS

FIG. 2(A) illustrates the beginning of inserting a terminal into a housing, FIGS. 2(B) and (C) illustrate the terminal in the process of insertion.

DESCRIPTION OF THE PREFERRED EMBODIMENTS

Embodiments of the invention will now be described with reference to the accompanying drawings.

Figure 1A:
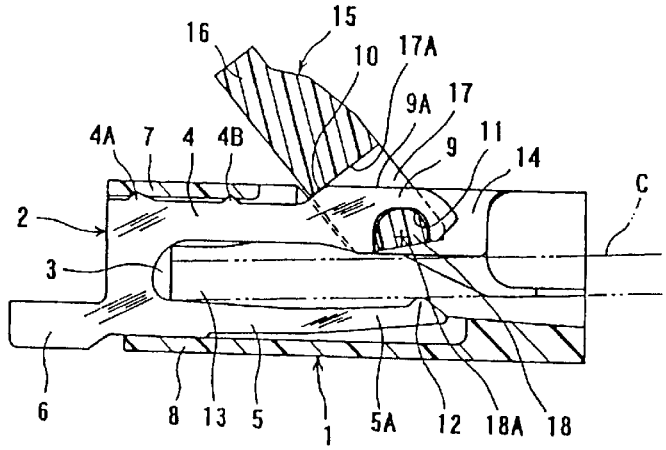
FIGS. 1(A) through (C) are cross-sectional views of an electrical connector according to an embodiment of the present invention. The pressure member is at the open position in FIG. 1(A), at in-between position in FIG. 1(B), and at the closed position in FIG. 1(C).
Figure 1B:
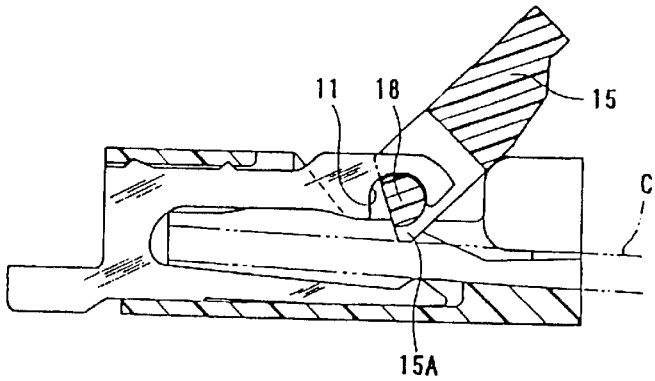
Figure 1C:
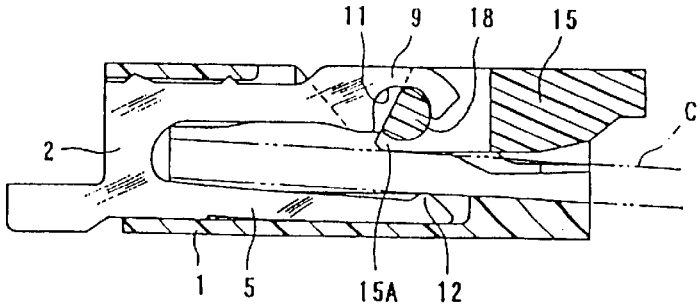

In the first embodiment of an electrical connector for a flat cable as shown in FIGS. 1(A) through (C), a substantially box-shaped housing 1 has a plurality of terminals 2. The terminals 2 are made by stamping a metal sheet, or by similar method, maintain each flat surface, and are arranged in perpendicular direction to the plane of the figure with a predetermined spacing.

The terminal 2 has an upper arm (support arm) 4, a lower arm 5, and a connect section 6, and is positioned along the inner surfaces of an upper and a lower walls which form a slot 3 of the housing. The connection section 6 protrudes outward of the housing; in opposite direction to the lower wall 8. The upper arm 4 has engaging protrusions 4A and 4B at an upper edge of its base section, so that the terminal is prevented from sliding out from the housing by engaging into the inner surface of the upper wall 7 of the housing when it is inserted from left side to the predetermined position. The upper arm 4 has relatively high rigidity, related to a deflection in the plane of the figure, particularly higher in comparison with the lower arm 4. An end 9 of the upper arm 4 is broader in height direction, and an upper edge 9A of the end 9 is positioned upward (outer) from a lower (inner) surface of the housing. Also, a transitional section between the upper edge 9A and the upper arm 4 forms a shoulder 10 with gentle slope, and gradually extends along the lower surface of the upper wall.

A groove-shaped bearing section 11 with concave curve is formed at lower part of the end 9. The bearing section 11 is to support a pressure member described below so as to freely turn over, and has a function of a bearing. Since the upper edge 9A is upward from the lower surface of the upper wall 7 and extends to a proximity of the upper surface, the width between a bottom of the groove of the bearing section and the upper edge 9A is so large in height direction that this area becomes strong.

The lower arm 5 of the terminal 2 has narrower width (dimension in height direction in the figure) in comparison with the upper arm 4, and has flexibility in a plane parallel to the plane of the figure. A lower edge of the lower arm 5, especially a portion close to the end, has an incline 5A which is slanted upward. In addition, a contact section 12 is formed at the end, and protrudes towards the bearing section 11 of the upper arm 4.

As described above, the housing 1 has as many receiving slots 3 parallel to the plane of the figure as terminals. The receiving slot 3 is to insert the terminal from left side, and the terminal is made from a metal sheet and maintains its metal sheet surface. The upper wall 7 and the lower wall 8 of the housing 1, which define the upper and lower ends of the receiving slot, determine an inserting position of the terminal 2. The base section of the lower arm 5 contacts with an inner surface of the lower wall 8, as described above, such that the engaging protrusions 4A and 4B engage the upper wall 7 of the housing to ensure the terminal position and prevent its sliding out. Also, the lower wall 8 covers the whole area of the lower surface of the housing, so that substantially whole area of the housing contact with a circuit board when the connector is mounted on the circuit board.

The housing 1 has a cable slot 13 to insert a flat cable C from right side into the housing 1. The cable slot 13 is formed so as to laterally link through the plurality of terminals between both side walls or at the width of the flat cable C (dimension in perpendicular direction to the plane of the figure), that is, with a width equal to a distance between ends of arranged terminals.

Also, the housing 1 has an opening at right side of the upper wall, and the upper part of the cable slot is open, which makes an open mouth. In other words, the open mouth 14 is open in right side and extends to the end of the upper wall of the housing 1 in left side, while it is open upward from the cable slot 13, as described above.

The open mouth 14 of the housing 1 has a pressure member 15 made of insulating material. The pressure member 15 is supported by the bearing section 11 of the terminal 2, so as to freely turn over between an open position in FIG. 1(A) and a closed position in FIG. 1(C). The pressure member 15 is placed into the opening of the upper wall at the open position, as illustrated in FIG. 1(A). The pressure member 15 has an operating section 16 at the top side and a groove 17 at the opposite side. The operating section 16 is a portion to give rotational force to the pressure member 15, and the groove 17 receives the end 9 of the terminal 12. Therefore, the groove 17 forms slits in zigzag fashion corresponding to the terminals 2. Moreover, a shaft 18 is provided in the groove 17, and supported by the bearing section 11 of the terminal 2 so as to freely rotate. The distance between a bottom 17A of the groove 17 and a center 18A of the shaft 18 (rotational axis) at the open position is designed so that the bottom 17A of the groove 17 strongly engages with a shoulder 10 of the terminal 2. The bottom 17A and the shoulder 10 form an engaging section together at the open position, and hold the pressure member 15 at the open position by its engaging force.

As described above, the connector in the present embodiment is used in the following manner.

(1) First, place the connector at a predetermined position on a circuit board (not illustrated), and then connect the connection section 6 of the terminal 2 with a corresponding circuit section on the circuit board by soldering or the like.

(2) After that, turn over a pressure member 15 upward to the open position as shown in FIG. 1(A). At the open position, the pressure member 15 is maintained at the open position being restricted from turning back to the closed position by an engaging force between the bottom 17A of a groove 17 of the pressure member 15 and the shoulder 10 of the terminal 2 which form an engaging section.

(3) When the pressure member is at the open position, the open mouth 14 is retained open wide rightward. Therefore, the entrance of the cable slot 13 (inserting space) is exposed enough to see from the inserting side of a flat cable C. The flat cable C needs to be inserted into the cable slot 13, having a contact surface as a lower surface, till its front edge contacts with the deepest wall.

(4) After inserting the cable to the predetermined position, release the engagement by turning the pressure member clockwise against the engaging force, and bring the pressure member 15 over to the closed position in FIG. 1(C) via the in-between position in FIG. 1(B). The pressure member 15 strongly presses the flat cable C towards a contact section 12 with the pressure section 15A, so that both are electrically connected.

Also, in the connector describe above, the terminal 2 is inserted into the housing in a manner illustrated in FIGS. 2(A) through (D).

(i) First, insert the upper arm 4 and the lower arm 5 of the terminal 2 into the receiving slot 3 of the housing from a side (left side in the figure), elastically deflecting the upper arm 4 and the lower arm 5 of the terminal 2 so as to make the distance between the ends of both arms narrower.

(ii) Proceed the insertion while the distance of the upper arm 4 and the lower arm 5 is kept narrow. See FIGS. 2(B) and (C).

(iii) Further proceeding the insertion, the end 9 of the upper arm 4 reaches an opening of the upper wall (upper portion of the open mouth 14). Being released from the elastic deformation, the terminal reaches the predetermined inserting position with the original shape. (FIG. 2(D)) At this time, the terminal 2 is secured to the housing 1 at a base side (left side in the figure).

Figure 2A:
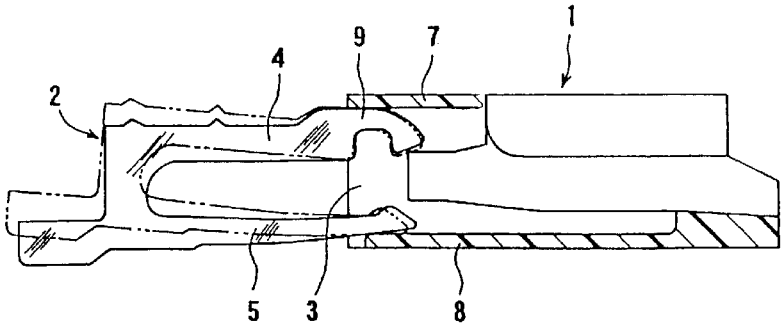
FIGS. 2(A) through (C) illustrate how to assemble the electrical connector of FIG. 1.
Figure 2B:
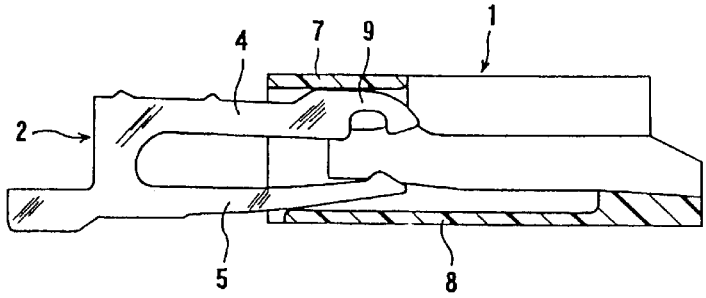
Figure 2C:
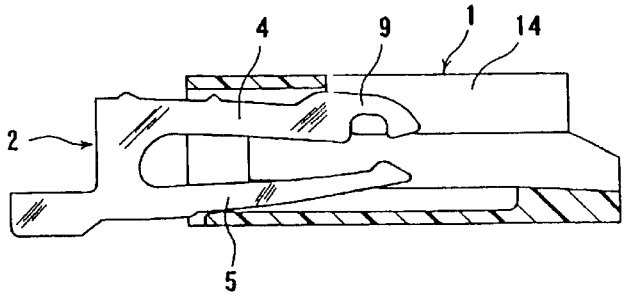
Figure 2D:
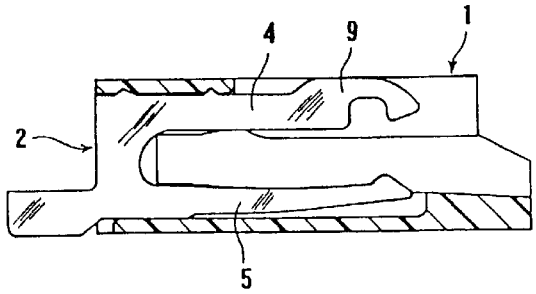
FIG. 2(D) illustrates the completion of the insertion.
Figure 3:
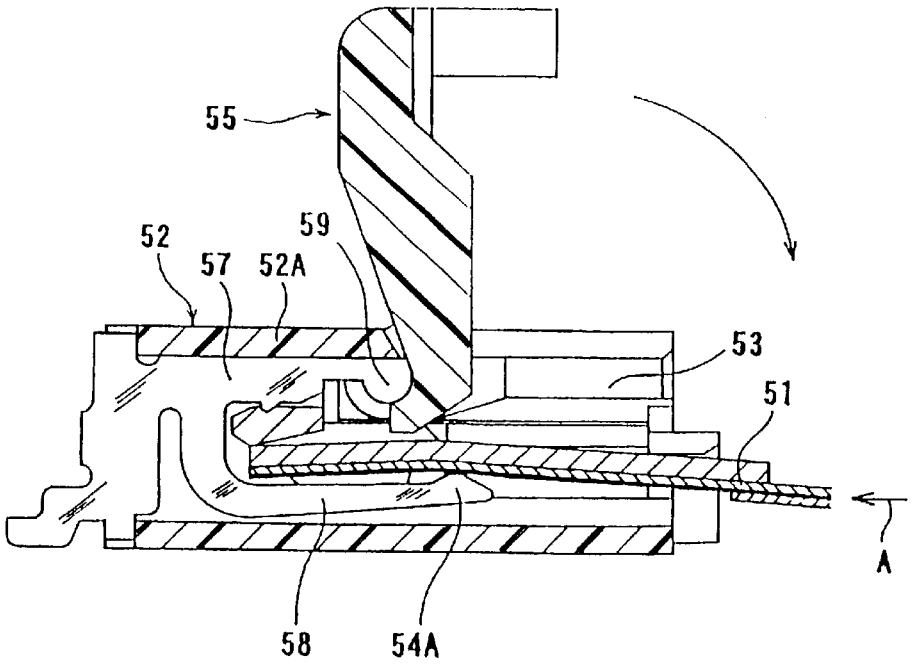
FIG. 3 is a cross-sectional view of a conventional electrical connector.

In addition, according to the present invention, since the lower arm 5 has an incline 5A at a lower edge close to the end, if the terminal is inserted being tilted in a manner that the incline slides along the inner surface of the lower wall 8, as illustrated by the two dotted lines in FIG. 2(A), the terminal can be inserted even if the degree of the elastic deformation between both arms is small. Here, the shape of the bearing section is not limited to concave curve, and can be a convex curve.

As described above, according to the present invention, since the bearing section of the support member to guide rotation of the pressure member is positioned outer than the lower surface of the upper wall of the housing in the opening of the housing, space for the thickness of the upper wall which is open because of the opening can be effectively used for the bearing section. Therefore, the connector can be low-profile for the thickness of the upper wall. Moreover, since it uses the space described above, the bearing section does not have to be made small in the height direction, and the strength of the bearing section itself and the area around the bearing section are not impaired. Also, since the support member is made of metallic material, such as a terminal, it can retain high strength in comparison with the upper wall of the housing. And, according to the method of the present invention, since the height dimension can be made small temporarily, the dimension of the housing does not need to be large; therefore the connector can be easily composed. In addition, since the lower arm has more flexibility than the upper arm, the lower arm elastically deforms when the distance between the arms is widen by the insertion of a flat cable. At this time, because of the lower arm's deflecting back to the original shape, the contact section provided to the lower arm can securely contact with the inserted cable.

What is claimed is:

1. A method for manufacturing an electrical connector for a flat cable, said electrical connector comprising, a substantially box-shaped housing having an open mouth to receive said flat cable and at least one receiving slot, at least one terminal inserted into said receiving slot from a side of said housing and arranged in said housing, said terminal having a contact section at a position facing to said open mouth, a pressure member positioned at an opposite side of said contact section with respect to said flat cable arranged on said contact section, and freely displaced between an open position at which an insertion space is open so that said flat cable is inserted into said open mouth and a closed position at which said insertion space is closed and said flat cable is pushed toward said contact section by said pressure member, and at least one support member held in said housing and having a bearing section which is able to support said pressure member such that said pressure member is freely displaced, wherein an upper edge of said bearing section is positioned higher than an inner surface of an upper wall of said housing, wherein said terminal includes a lower arm extending along said a lower wall of said housing and having said contact section, and an upper arm extending along said upper wall of said housing and having said bearing section, at least one of said lower and upper arms being so flexibile that said lower and upper arms can be inserted into said receiving slot and attached to an inner surface of said lower wall and said inner surface of said upper wall, respectively, said method comprising the step of:

inserting said terminal into said receiving slot in a manner that said upper arm and said lower arm are guided by said inner surfaces of said upper and lower walls respectively, while said lower arm is deflected toward said upper arm and then deflected back to its original shape at a time of insertion to a predetermined position.

2. A method for manufacturing an electrical connector for a flat cable, said electrical connector comprising, a substantially box-shaped housing having an open mouth to receive said flat cable and at least one receiving slot, at least one terminal inserted into said receiving slot from a side of said housing and arranged in said housing, said terminal having a contact section at a position facing to said open mouth, a pressure member positioned at an opposite side of said contact section with respect to said flat cable arranged on said contact section, and freely rotatable around a rotation axis between an open position at which an insertion space is open so that said flat cable can be inserted into said open mouth and a closed position at which said insertion space is closed and said flat cable is pushed toward said contact section by said pressure member, and at least one support member held in said housing and having a bearing section which is able to support said pressure member such that said pressure member is freely rotated, wherein when said pressure member is at said open position, an upper edge of said bearing section is positioned higher than an inner surface of an upper wall of said housing, wherein said terminal includes a lower arm extending along said a lower wall of said housing and having said contact section, and an upper arm extending along said upper wall of said housing and having said bearing section, at least one of said lower and upper arms being so flexibile that said lower and upper arms can be inserted into said receiving slot and attached to an inner surface of said lower wall and said inner surface of said upper wall, respectively, said method comprising the step of:

inserting said terminal into said receiving slot in a manner that said upper arm and said lower arm are guided by said inner surfaces of said upper and lower walls, respectively, while said lower arm is deflected toward said upper arm and then deflected back to its original shape at a time of insertion to a predetermined position.

3. A method for manufacturing an electrical connector for a flat cable, said electrical connector comprising an electrical connector for a flat cable, comprising, a substantially box-shaped housing having an open mouth to receive said flat cable and at least one receiving slot, at least one terminal inserted into said receiving slot from a side of said housing and arranged in said housing, said terminal including a lower arm having a contact section at a position facing to said open mouth and an upper arm extending along said lower arm and having an upper edge positioned above an inner surface of an upper wall of said housing, and a pressure member supported by said upper arm, positioned at an opposite side of said contact section with respect to said flat cable arranged on said contact section, and freely rotatable around a rotation axis between an open position at which an insertion space is open so that said flat cable can be inserted into said open mouth and a closed position at which said insertion space is closed and said flat cable is pushed toward said contact section by said pressure member, said method comprising the step of:

inserting said terminal into said receiving slot in a manner that said upper arm and said lower arm are guided by said inner surface of said upper wall and an inner surface of said lower wall, respectively, while said lower arm is deflected toward said upper arm and then deflected back to its original shape at a time of insertion to a predetermined position.

4. A method for manufacturing an electrical connector for a flat cable, said electrical connector comprising, a substantially box-shaped housing having an open mouth to receive said flat cable and at least one receiving slot, at least one terminal inserted into said receiving slot from a side of said housing and arranged in said housing, said terminal having a contact section at a position facing to said open mouth, a pressure member positioned at an opposite side of said contact section with respect to said flat cable arranged on said contact section, and freely displaced between an open position at which an insertion space is open so that said flat cable is inserted into said open mouth and a closed position at which said insertion space is closed and said flat cable is pushed toward said contact section by said pressure member, and at least one support member held in said housing and having a bearing section which is able to support said pressure member such that said pressure member is freely displaced, wherein an upper edge of said bearing section is positioned higher than an inner surface of an upper wall of said housing, wherein said terminal includes a lower arm extending along said a lower wall of said housing and having said contact section and a lower edge slanted upwardly to an end thereof, and an upper arm extending along said upper wall of said housing and having said bearing section, at least one of said lower and upper arms being so flexibile that said lower and upper arms can be inserted into said receiving slot and attached to an inner surface of said lower wall and said inner surface of said upper wall, respectively, said method comprising the steps of:

tilting said terminal downward so that said slanted lower edge of said lower arm is parallel to said inner surface of said lower wall;

inserting said terminal such that said slanted edge is guided to said inner surface of said lower wall; and completing said insertion to a predetermined position by releasing said tilting of said lower arm.

5. A method for manufacturing an electrical connector for a flat cable, said electrical connector comprising, a substantially box-shaped housing having an open mouth to receive said flat cable and at least one receiving slot, at least one terminal inserted into said receiving slot from a side of said housing and arranged in said housing, said terminal having a contact section at a position facing to said open mouth, a pressure member positioned at an opposite side of said contact section with respect to said flat cable arranged on said contact section, and freely rotatable around a rotation axis between an open position at which an insertion space is open so that said flat cable can be inserted into said open mouth and a closed position at which said insertion space is closed and said flat cable is pushed toward said contact section by said pressure member, and at least one support member held in said housing and having a bearing section which is able to support said pressure member such that said pressure member is freely rotated, wherein when said pressure member is at said open position, an upper edge of said bearing section is positioned higher than an inner surface of an upper wall of said housing, wherein said terminal includes a lower arm extending along said a lower wall of said housing and having said contact section and a lower edge slanted upwardly to an end thereof, and an upper arm extending along said upper wall of said housing and having said bearing section, at least one of said lower and upper arms being so flexibile that said lower and upper arms can be inserted into said receiving slot and attached to an inner surface of said lower wall and said inner surface of said upper wall, respectively, said method comprising the steps of:

tilting said terminal downward so that said slanted lower edge of said lower arm is parallel to said inner surface of said lower wall;

inserting said terminal such that said slanted edge is guided to said inner surface of said lower wall; and completing said insertion to a predetermined position by releasing said tilting of said lower arm.

6. A method for manufacturing an electrical connector for a flat cable, said electrical connector comprising an electrical connector for a flat cable, comprising, a substantially box-shaped housing having an open mouth to receive said flat cable and at least one receiving slot, at least one terminal inserted into said receiving slot from a side of said housing and arranged in said housing, said terminal including a lower arm having a contact section at a position facing to said open mouth and a lower edge slanted upwardly to an end thereof and an upper arm extending along said lower arm and having an upper edge positioned above an inner surface of an upper wall of said housing, and a pressure member supported by said upper arm, positioned at an opposite side of said contact section with respect to said flat cable arranged on said contact section, and freely rotatable around a rotation axis between an open position at which an insertion space is open so that said flat cable can be inserted into said open mouth and a closed position at which said insertion space is closed and said flat cable is pushed toward said contact section by said pressure member, said method comprising the steps of:

tilting said terminal downward so that said slanted lower edge of said lower arm is parallel to said inner surface of said lower wall;

inserting said terminal such that said slanted edge is guided to said inner surface of said lower wall; and completing said insertion to a predetermined position by releasing said tilting of said lower arm.

* * * * *